US009947997B2

(12) United States Patent
Lin et al.

(10) Patent No.: US 9,947,997 B2
(45) Date of Patent: Apr. 17, 2018

(54) ELECTRONIC DEVICE

(71) Applicant: Chiun Mai Communication Systems, Inc., New Taipei (TW)

(72) Inventors: Yen-Hui Lin, New Taipei (TW); Chien-Chang Liu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 4 days.

(21) Appl. No.: 15/358,277

(22) Filed: Nov. 22, 2016

(65) Prior Publication Data

US 2017/0155187 A1 Jun. 1, 2017

(30) Foreign Application Priority Data

Nov. 30, 2015 (CN) ..... 2015 1 0858151

(51) Int. Cl.
*H01Q 1/48* (2006.01)
*H01Q 1/27* (2006.01)
*H01Q 1/22* (2006.01)

(52) U.S. Cl.
CPC ..... *H01Q 1/273* (2013.01); *H01Q 1/2291* (2013.01); *H01Q 1/48* (2013.01)

(58) Field of Classification Search
CPC ..... H01Q 1/273; H01Q 1/48; H01Q 1/2291
USPC ..... 343/718
See application file for complete search history.

(56) References Cited

U.S. PATENT DOCUMENTS 8,199,057 B2 6/2012 Ishizuka et al.
2014/0253398 A1 9/2014 Hsieh et al.

FOREIGN PATENT DOCUMENTS

CN 104638361 A 5/2015

*Primary Examiner* — Andrea Lindgren Baltzell
(74) *Attorney, Agent, or Firm* — ScienBiziP, P.C.

(57) ABSTRACT

An electronic device includes a main body, a baseboard, a ground portion, and a frequency selected ground (FSG) circuit. The baseboard is received in the main body and is spaced from the main body. The baseboard and the main body together forms a gap and the baseboard includes a feed point for feeding current to the main body. The ground portion is grounded and electrically connects the main body to the baseboard. The ground portion covers a portion of the gap to form a grounding area and a non-grounding area. One end of the FSG circuit is electrically connected to the main body and another end of the FSG circuit is grounded. The FSG circuit includes a plurality of inductors and/or capacitors. The FSG circuit has different impedances in response to the electronic device working at different frequency bands.

17 Claims, 8 Drawing Sheets

ELECTRONIC DEVICE

CROSS-REFERENCE TO RELATED APPLICATIONS

This application claims priority to Chinese Patent Application No. 201510858151.5 filed on Nov. 30, 2015, the contents of which are incorporated by reference herein.

FIELD

The subject matter herein generally relates to an electronic device having a metal housing.

BACKGROUND

Wearable devices, such as smart watches and bracelets, generally have a wireless connectivity and include an antenna for establishing a wireless communication connection with other electronic devices, for example, mobile phones or personal digital assistants. Additionally, many wearable devices further have metal housings for improving heat dissipation, protecting the components of the electronic device, as well as other purposes.

BRIEF DESCRIPTION OF THE DRAWINGS

Implementations of the present disclosure will now be described, by way of example only, with reference to the attached figures.

DETAILED DESCRIPTION

Figure 1:
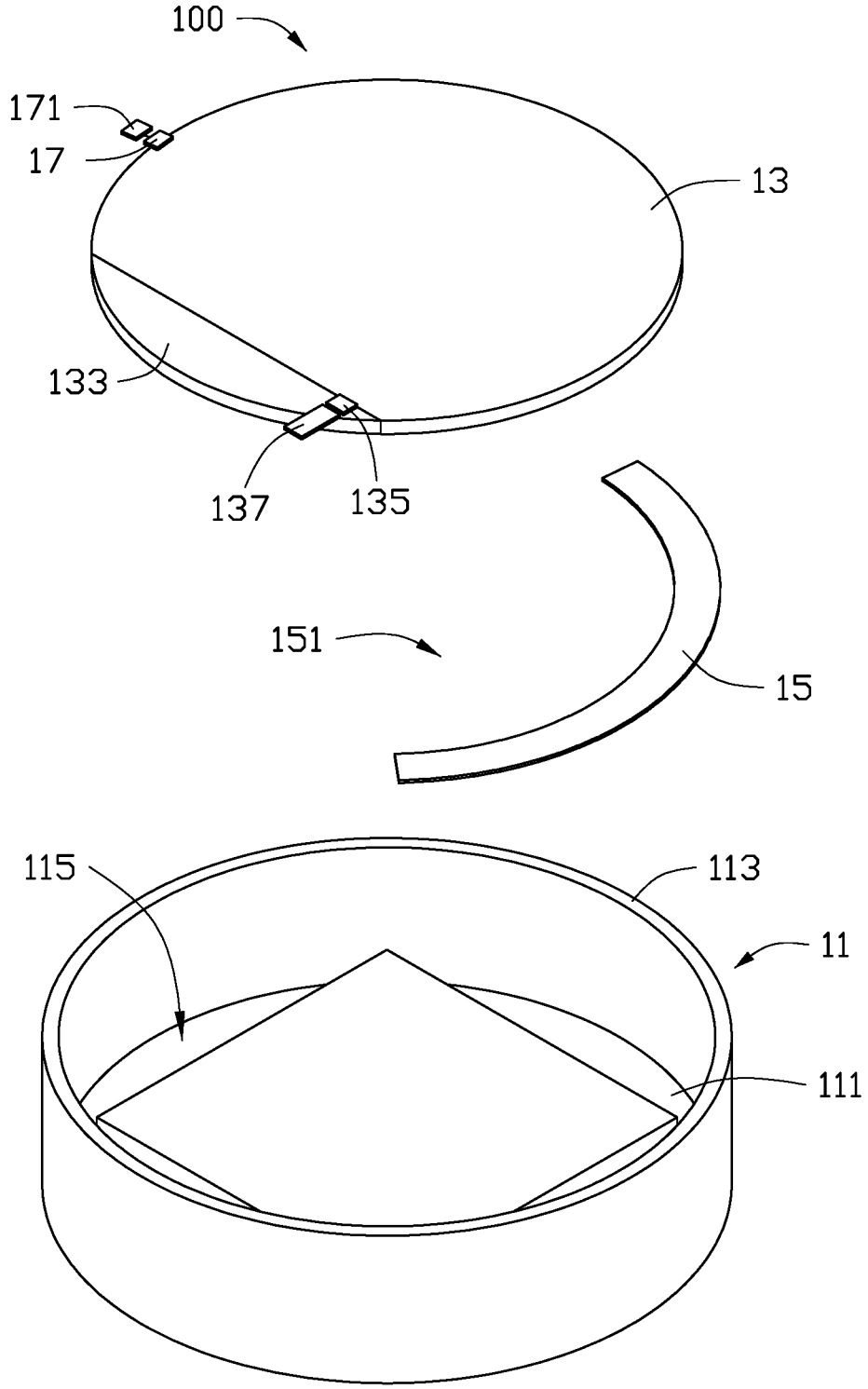
FIG. 1 is an exploded, isometric view of a first exemplary embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder.

The term "comprising," when utilized, means "including, but not necessarily limited to"; it specifically indicates open-ended inclusion or membership in the so-described combination, group, series and the like.

The present disclosure is described in relation to an electronic device.

FIG. 1 illustrates a first exemplary embodiment of an electronic device 100, which can be a wearable device, for example, a bracelet, a smart watch, a pair of glasses, and/or a helmet. The electronic device 100 can also be an electronic product, for example, a mobile phone or a personal digital assistant. In this exemplary embodiment, the electronic device 100 is a smart watch.

The electronic device 100 includes a main body 11, a baseboard 13, a ground portion 15, and a Frequency Selected Ground (FSG) circuit 17.

In this exemplary embodiment, the main body 11 is substantially circular. The main body 11 is made of a conductive material, for example, a metallic material. It is understood that a shape of the main body 11 need not be limited to being circular. The main body 11 can have other shapes as well, for example, rectangular or oval. The main body 11 includes a bottom wall 111 and a peripheral wall 113. The peripheral wall 113 is positioned at a periphery of the bottom wall 111. The bottom wall 111 and the peripheral wall 113 together form a receiving space 115 with one open end.

Figure 2:
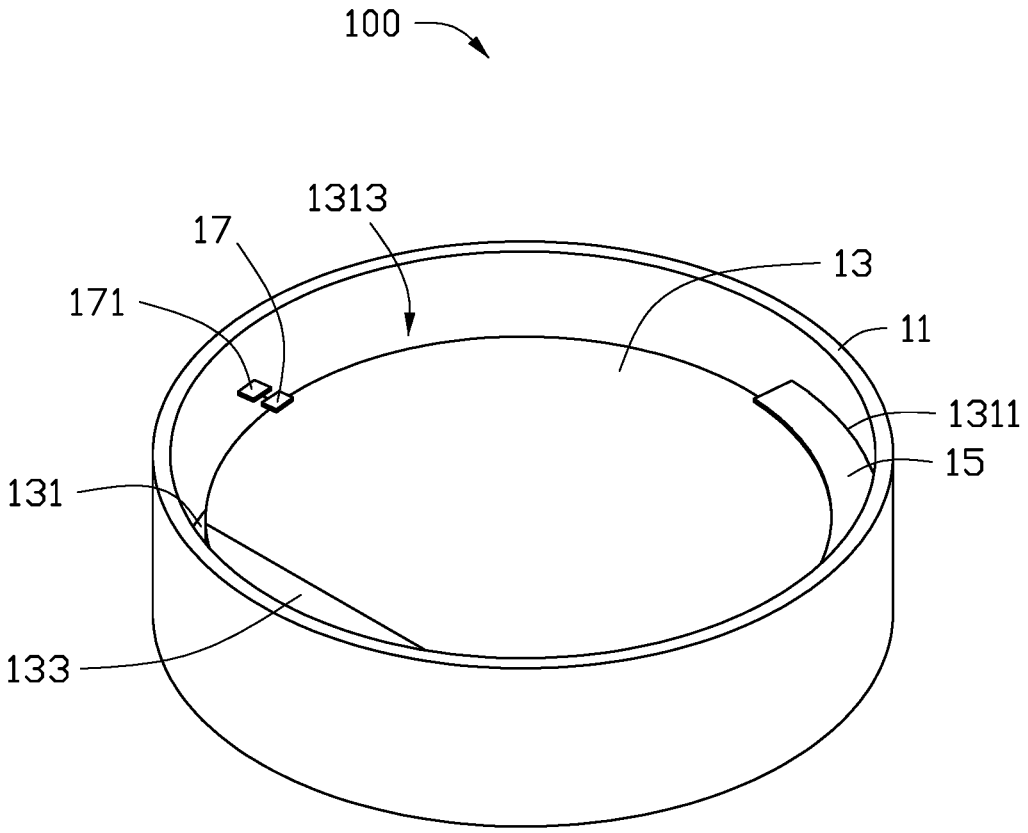
FIG. 2 is an isometric view of the electronic device of FIG. 1.
Figure 3:
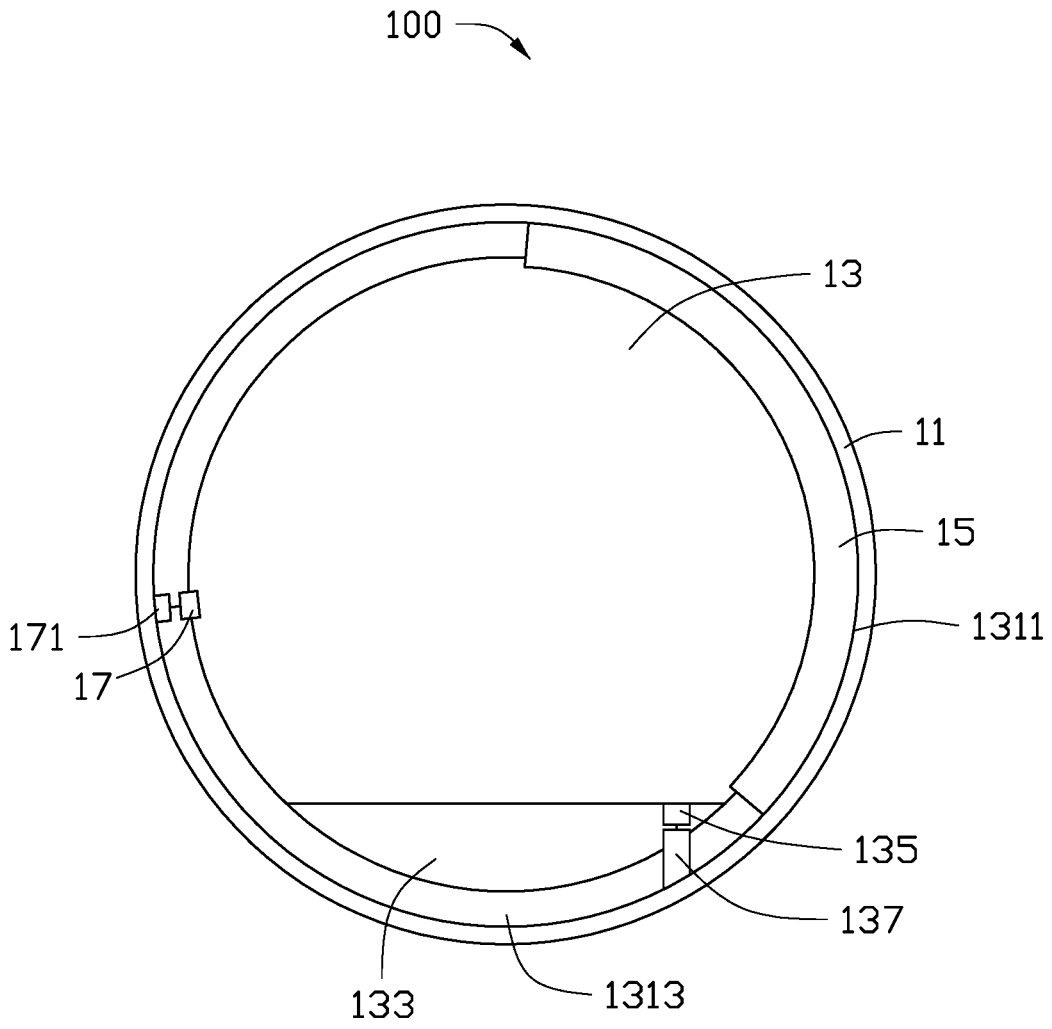
FIG. 3 is similar to FIG. 2, but shown from another angle.

As illustrated in FIG. 2 and FIG. 3, in this exemplary embodiment, the baseboard 13 is a printed circuit board (PCB). The baseboard 13 is positioned in the receiving space 115 and is spaced from the main body 11. That is, a periphery of the baseboard 13 is spaced from the peripheral wall 113 of the main body 11 to define a gap 131 therebetween (shown in FIG. 2). In at least one exemplary embodiment, the gap 131 is substantially a loop.

The baseboard 13 further includes a keep-out-zone 133 and a feed point 135. The keep-out-zone 133 is positioned at one side of the baseboard 13. The purpose of the keep-out-zone 133 is to delineate an area on the baseboard 13 in which other electronic elements (such as a battery, a vibrator, a camera, a speaker, a charge coupled device, etc.) cannot be placed. The keep-out-zone 133 prevents electronic elements from interfering with the electronic device 100.

In at least one exemplary embodiment, the feed point 135 is positioned on the keep-out-zone 133 and is electrically connected to the main body 11 through a connecting portion 137, such as a piece of conductor, a probe pin, or the like. The feed point 135 is further electrically connected to a signal source, for example, a radio frequency (RF) transceiving unit (not shown) for feeding current to the main body 11.

In at least one exemplary embodiment, the ground portion 15 is substantially an arc-shaped sheet. The ground portion 15 is made of conductive material and is grounded. An opening 151 is defined by one end of the ground portion 15. In this exemplary embodiment, a width of the ground portion 15 is greater than a width of the gap 131. The ground portion 15 is configured to be positioned on the baseboard 13 to cover a portion of the gap 131. Then, a grounding area 1311 is formed for connecting the main body 11 to the baseboard 13. Another portion of the gap 131, not covered by the ground portion 15, forms an arc-shaped non-grounding area 1313.

In other exemplary embodiments, a width of the ground portion 15 can be equal to a width of the gap 131. Then the ground portion 15 is received in the gap 131. A portion of the gap 131 is filled with the ground portion 15, and the main body 11 is electrically connected to the baseboard 13 through the ground portion 15.

The FSG circuit 17 is positioned at one side of the baseboard 13 adjacent to the non-grounding area 1313. One end of the FSG circuit 17 is electrically connected to the main body 11 through a connecting structure 171, for example, a piece of conductor, a probe pin, or the like. Another end of the FSG circuit 17 is grounded. The FSG circuit 17 includes a plurality of inductors and/or capacitors. Then, when the electronic device 100 works at different frequency bands, the FSG circuit 17 has different impedances.

Figure 4:
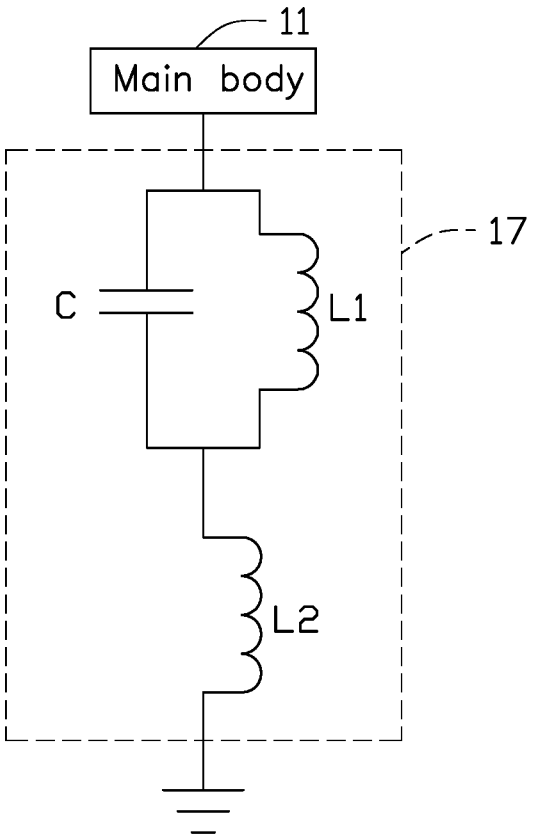
FIG. 4 is a circuit diagram of a FSG circuit of the electronic device of FIG. 1.

As illustrated in FIG. 4, in this exemplary embodiment, the FSG circuit 17 includes a first inductor L1, a second inductor L2, and a capacitor C. One end of the first inductor L1 is electrically connected to an end of the capacitor C and the main body 11. Another end of the first inductor L1 is electrically connected to another end of the capacitor C and an end of the second inductor L2. Another end of the second inductor L2 is grounded. That is, the first inductor L1 and the capacitor C are connected in parallel. The first inductor L1 and the capacitor C connected in parallel are connected between the main body 11 and the second inductor L2. The first inductor L1 and the capacitor C connected in parallel are further connected in series with the second inductor L2. In at least one exemplary embodiment, an inductance of the first inductor L1 is about 3.9 nH. An inductance of the second inductor L2 is about 2.9 nH. A capacitance of the capacitor C is about 2.4 pF.

Figure 5:
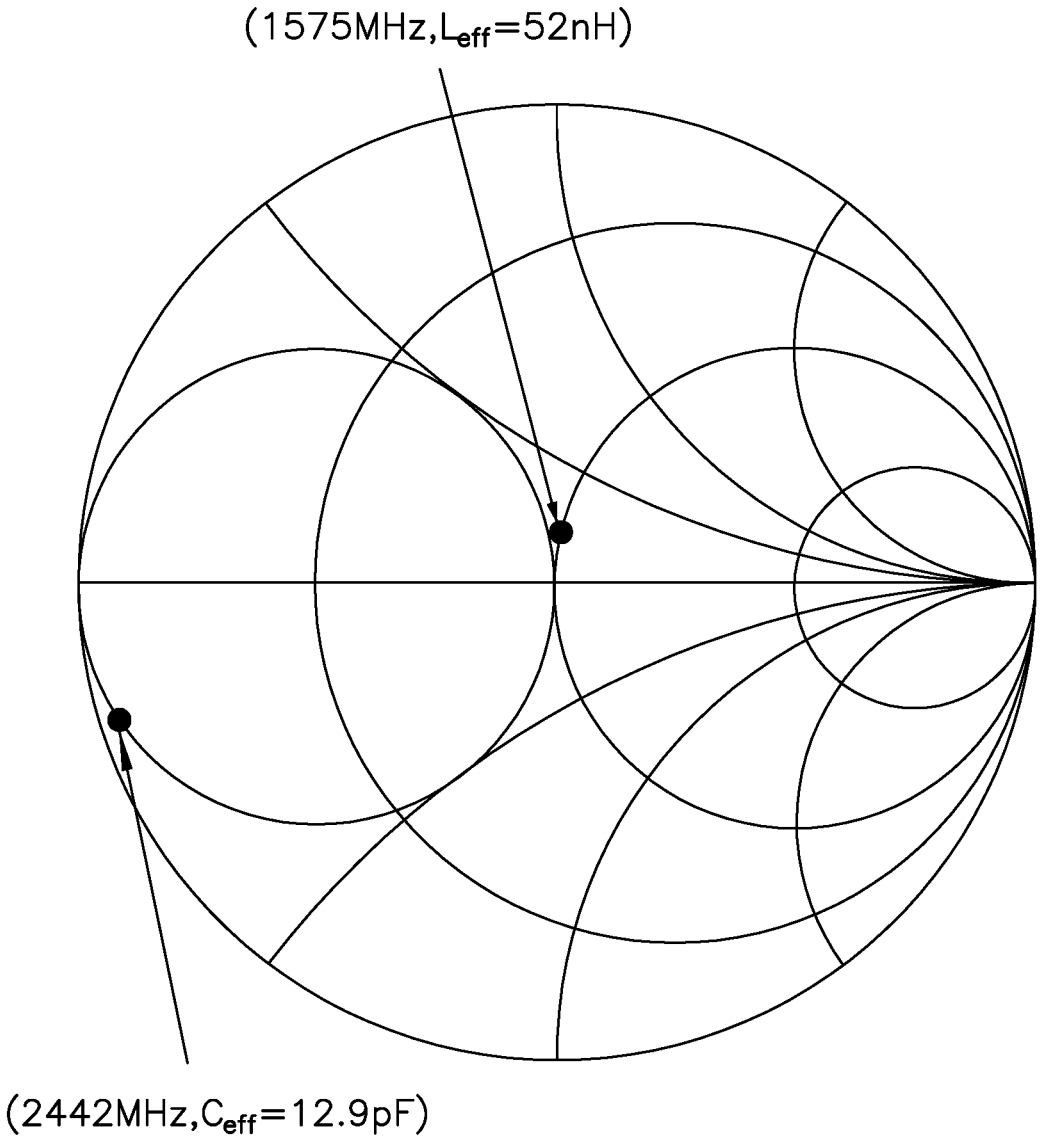
FIG. 5 is a Smith chart of the FSG circuit of the electronic device of FIG. 4.

FIG. 5 illustrates an exemplary embodiment of a Smith chart of the FSG circuit 17 of the electronic device 100 when an inductance of the first inductor L1 is about 3.9 nH, an inductance of the second inductor L2 is about 2.9 nH, and a capacitance of the capacitor C is about 2.4 pF. When the electronic device 100 works at a first frequency band, for example, GPS band (1575 MHz), the FSG circuit 17 acts substantially as an inductor and an equivalent inductance $L_{eff}$ of the FSG circuit 17 is about 52 nH. When the electronic device 100 works at a second frequency band, for example, WIFI band (2442 MHz), the FSG circuit 17 acts substantially as a capacitor and an equivalent capacitance $C_{eff}$ is about 12.9 pF. That is, when the electronic device 100 works at the first frequency band, the FSG circuit 17 is in an open-circuit state. When the electronic device 100 works at the second frequency band, the FSG circuit 17 is in a short-circuit state.

Figure 6:
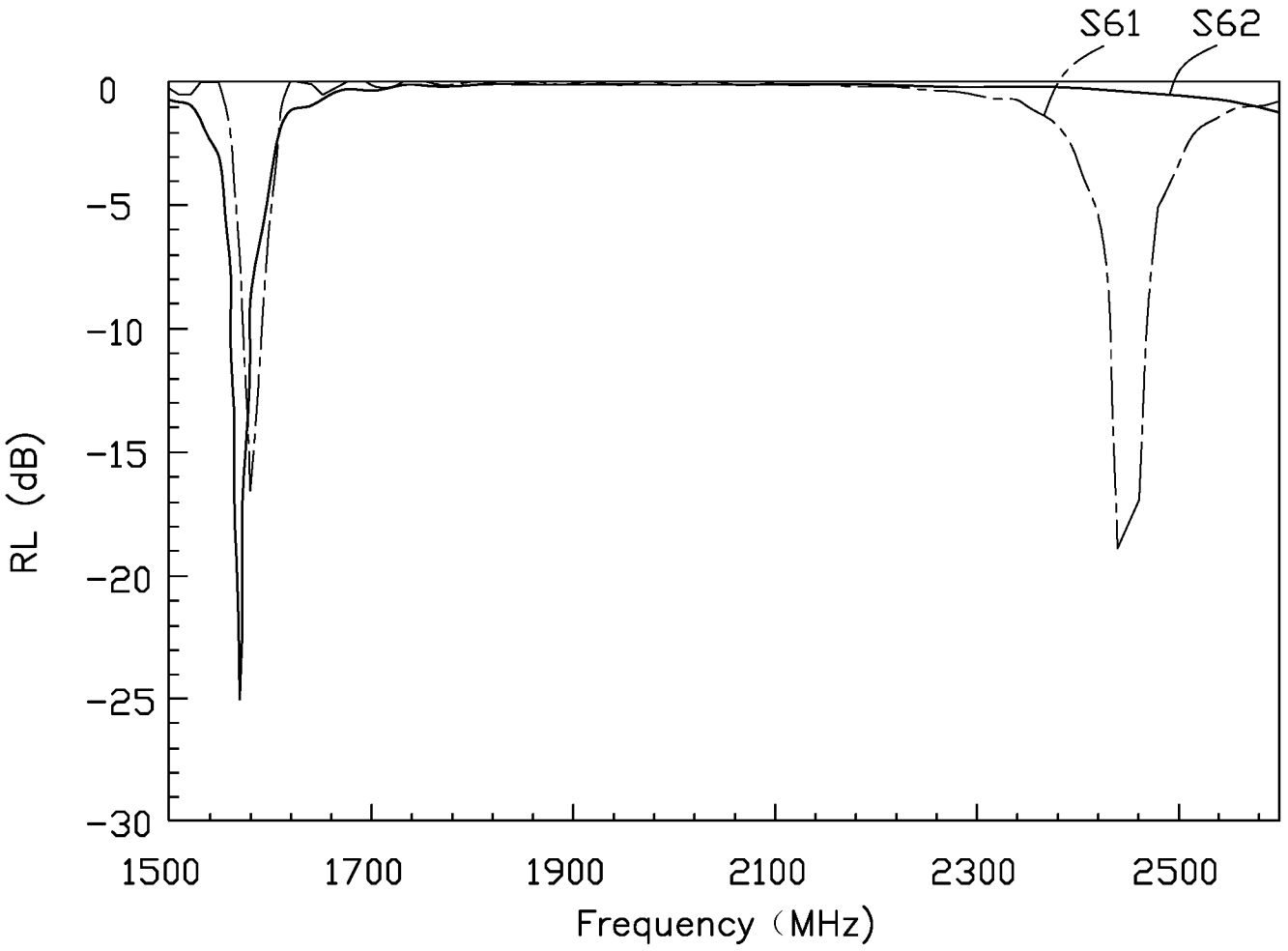
FIG. 6 is a return loss graph of the electronic device of FIG. 1.

FIG. 6 illustrates an exemplary embodiment of a return loss graph of the electronic device 100. Curve S61 illustrates a return loss of the electronic device 100 when the electronic device 100 has the FSG circuit 17. Curve S62 illustrates a return loss of the electronic device 100 when the electronic device 100 does not have the FSG circuit 17. It can be derived from FIG. 6 that when the electronic device 100 includes the FSG circuit 17, the electronic device 100 can activate another mode at the 2.4 GHz frequency band to obtain dual-frequency band design.

Table 1 shows a radiating efficiency and a total efficiency of the electronic device 100 working at the first frequency band and the second frequency band when the electronic device 100 includes the FSG circuit 17. It can be derived from Table 1 that when the electronic device 100 includes the FSG circuit 17, the electronic device 100 has a good radiating performance at the GPS band and the WIFI band.

TABLE 1

| Frequency bands | Frequencies (MHz) | Radiating efficiency (dB) | Total efficiency (dB) |
|---|---|---|---|
| GPS | 1570 | −6.46 | −7.63 |
| | 1575 | −5.43 | −5.90 |
| | 1580 | −5.00 | −5.12 |
| | 1585 | −4.92 | −5.03 |
| BT/WIFI | 2400 | −0.99 | −2.32 |
| | 2442 | −1.95 | −2.03 |
| | 2484 | −1.53 | −2.57 |

Figure 7:
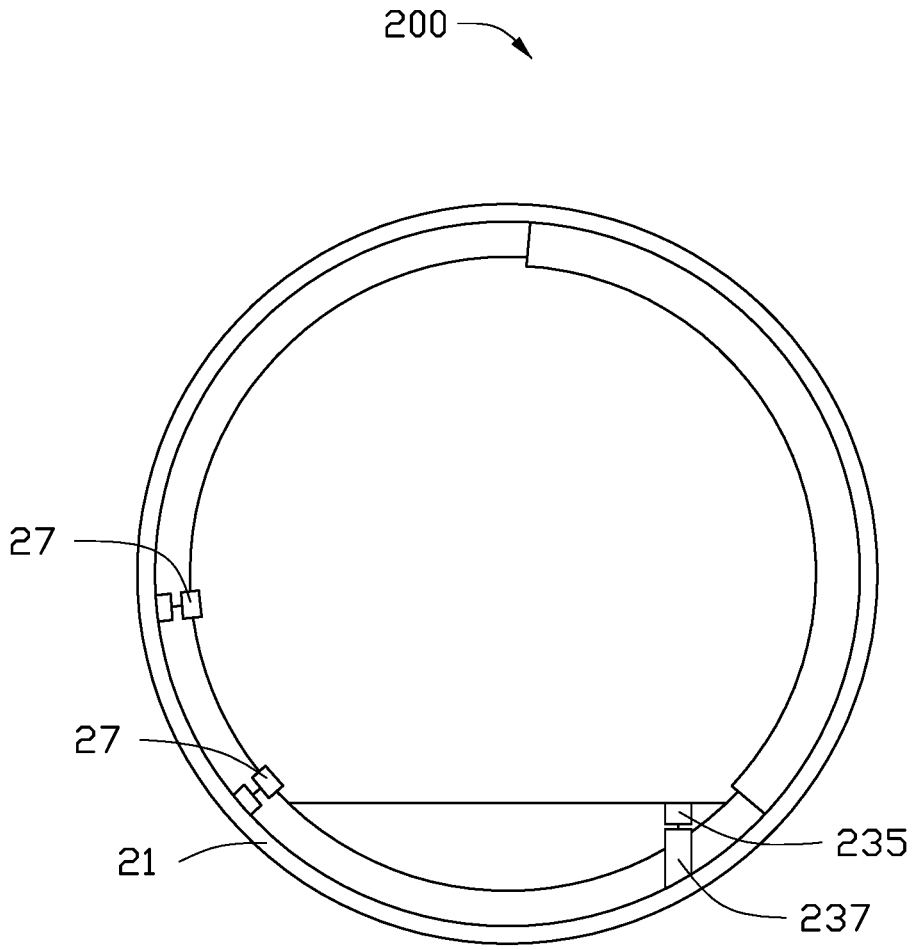
FIG. 7 is an elevational view of a second exemplary embodiment of an electronic device.

FIG. 7 illustrates a second exemplary embodiment of an electronic device 200. The electronic device 200 comprises a main body 21, a feed point 235, and a connecting portion 237. The electronic device 200 differs from the electronic device 100 in that the electronic device 200 includes a plurality of FSG circuits 27.

Figure 8:
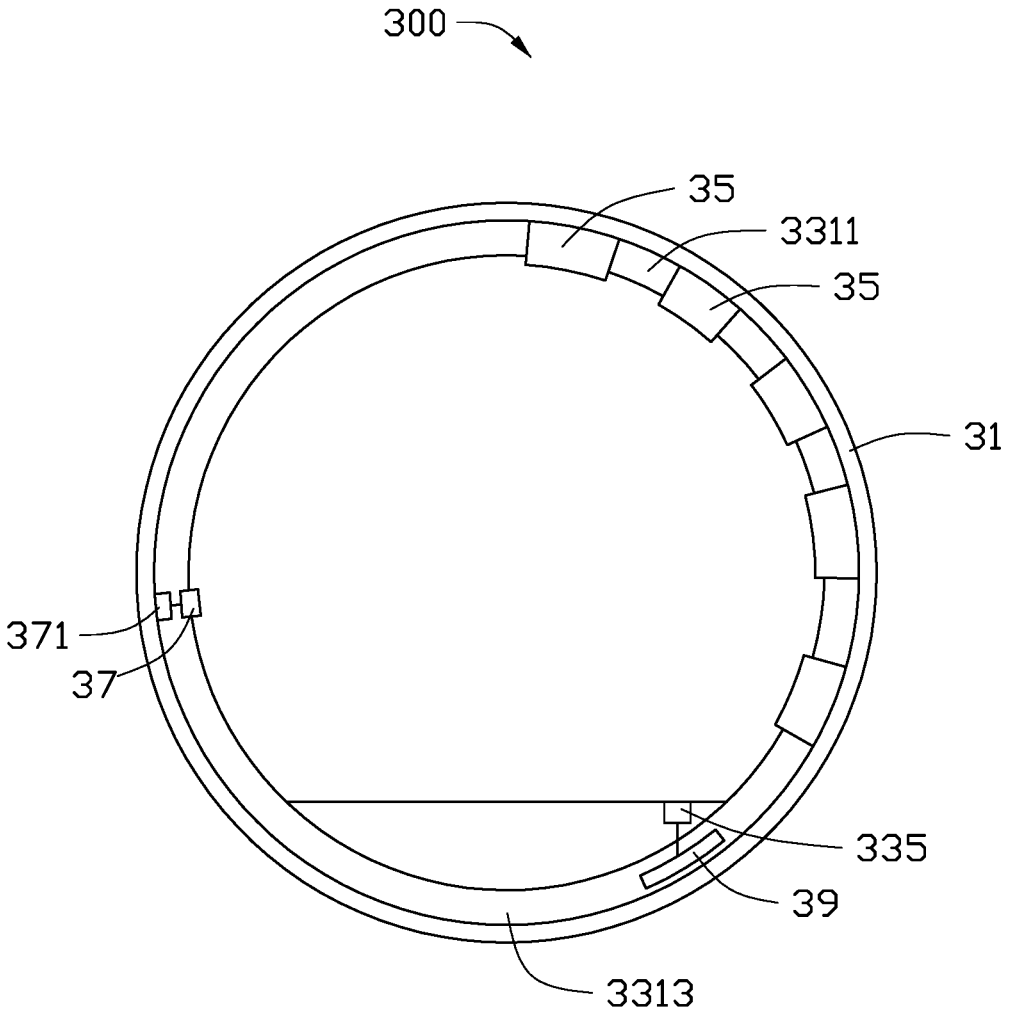
FIG. 8 is an elevational view of a third exemplary embodiment of an electronic device.

FIG. 8 illustrates a third exemplary embodiment of an electronic device 300. The electronic device 300 comprises a main body 31, a feed point 335, and a FSG circuit 37. The FSG circuit 37 includes a connecting structure 371. The electronic device 300 differs from the electronic device 100 in that the electronic device 300 includes a plurality of ground points 35. The plurality of ground points 35 are positioned in the grounding area 3311 and are spaced from each other to connect the main body 31 to the baseboard. Additionally, the electronic device 300 further includes a radiating portion 39. The radiating portion 39 is positioned in the non-grounding area 3313. One end of the radiating portion 39 is electrically connected the feed point 335. Another end of the radiating portion 39 is spaced from the main body 31. Thus, a signal from the radiating portion 39 can be coupled to the main body 31.

The exemplary embodiments shown and described above are only examples. Many details are often found in the art such as the other features of the electronic device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the exemplary embodiments described above may be modified within the scope of the claims.

What is claimed is:

1. An electronic device comprising:

a main body, the main body formed of conductive material;

a baseboard, the baseboard received in the main body and spaced from the main body, the baseboard and the main body together forming a gap, and the baseboard comprising a feed point for feeding current to the main body;

a ground portion, the ground portion being grounded and electrically connecting the main body to the baseboard, the ground portion covering a portion of the gap to form a grounding area and a non-grounding area; and a frequency selected ground (FSG) circuit, the FSG circuit positioned at one side of the baseboard adjacent to the non-grounding area, one end of the FSG circuit electrically connected to the main body, and another end of the FSG circuit being grounded;

wherein the FSG circuit comprises a plurality of inductors and/or capacitors, wherein the FSG circuit has different impedances in response to the electronic device working at different frequency bands.

2. The electronic device of claim 1, wherein a width of the ground portion is greater than a width of the gap, the ground portion is positioned on the baseboard and covers one portion of the gap to form the grounding area.

3. The electronic device of claim 1, wherein a width of the ground portion is substantially equal to a width of the gap, the ground portion is received in the gap, and one portion of the gap is filled with the ground portion to form the grounding area.

4. The electronic device of claim 1, wherein the FSG circuit comprises a first inductor, a second inductor, and a capacitor, one end of the first inductor is electrically connected to one end of the capacitor and the main body, another end of the first inductor is electrically connected to another end of the capacitor and an end of the second inductor, and another end of the second inductor is grounded.

5. The electronic device of claim 1, wherein the baseboard further comprises a keep-out-zone, the keep-out-zone is positioned adjacent to the non-grounding area.

6. The electronic device of claim 1, wherein the ground portion is substantially an arc-shaped sheet, an opening is defined by one end of the ground portion, the ground portion is positioned in the grounding area, and one portion of the gap corresponding to the opening forms the non-grounding area.

7. The electronic device of claim 1, wherein the grounding portion comprises a plurality of grounding points, the plurality of ground points is positioned in the grounding area, and wherein the ground points are spaced from each other to connect the main body to the baseboard.

8. The electronic device of claim 1, further comprising a radiating portion having two ends, wherein the radiating portion is positioned in the non-grounding area, one end of the radiating portion is electrically connected the feed point, another end of the radiating portion is spaced from the main body.

9. An electronic device comprising:

a main body, the main body formed of conductive material;

a baseboard, the baseboard received in the main body and spaced from the main body, the baseboard and the main body together forming a gap, and the baseboard comprising a feed point for feeding current to the main body;

a ground portion, the ground portion being grounded and electrically connecting the main body to the baseboard, the ground portion covering a portion of the gap to form a grounding area and a non-grounding area; and a frequency selected ground (FSG) circuit, the FSG circuit positioned at one side of the baseboard adjacent to the non-grounding area, one end of the FSG circuit electrically connected to the main body, and another end of the FSG circuit being grounded;

wherein the FSG circuit comprises a plurality of inductors and/or capacitors, wherein when the electronic device works at a first frequency band, the FSG circuit is in an open-circuit state, and when the electronic device works at a second frequency band, the FSG circuit is in a short-circuit state.

10. The electronic device of claim 9, wherein the first frequency band is a GPS band and the second frequency band is a WIFI band.

11. The electronic device of claim 9, wherein a width of the ground portion is greater than a width of the gap, the ground portion is positioned on the baseboard and covers one portion of the gap to form the grounding area.

12. The electronic device of claim 9, wherein a width of the ground portion is substantially equal to a width of the gap, the ground portion is received in the gap, and one portion of the gap is filled with the ground portion to form the grounding area.

13. The electronic device of claim 9, wherein the FSG circuit comprises a first inductor, a second inductor, and a capacitor, one end of the first inductor is electrically connected to one end of the capacitor and the main body, another end of the first inductor is electrically connected to another end of the capacitor and an end of the second inductor, and another end of the second inductor is grounded.

14. The electronic device of claim 9, wherein the baseboard further comprises a keep-out-zone, the keep-out-zone is positioned adjacent to the non-grounding area.

15. The electronic device of claim 9, wherein the ground portion is substantially an arc-shaped sheet, an opening is defined by one end of the ground portion, the ground portion is positioned in the grounding area, and one portion of the gap corresponding to the opening forms the non-grounding area.

16. The electronic device of claim 9, wherein the grounding portion comprises a plurality of grounding points, the plurality of ground points is positioned in the grounding area, and wherein the ground points are spaced from each other to connect the main body to the baseboard.

17. The electronic device of claim 9, further comprising a radiating portion having two ends, wherein the radiating portion is positioned in the non-grounding area, one end of the radiating portion is electrically connected the feed point, another end of the radiating portion is spaced from the main body.

* * * * *